US006995784B2

(12) United States Patent
Kalishek

(10) Patent No.: US 6,995,784 B2
(45) Date of Patent: Feb. 7, 2006

(54) SECURE POINT OF SALE IMAGEABLE SUBSTRATE

(75) Inventor: Robert John Kalishek, Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 91 days.

(21) Appl. No.: 10/703,496

(22) Filed: Nov. 10, 2003

(65) Prior Publication Data

US 2004/0104992 A1 Jun. 3, 2004

Related U.S. Application Data

(60) Provisional application No. 60/425,279, filed on Nov. 12, 2002.

(51) Int. Cl.
*B41M 5/40* (2006.01)

(52) U.S. Cl. ..... 347/221

(58) Field of Classification Search ..... 347/221; 503/200, 201

See application file for complete search history.

(56) References Cited

U.S. PATENT DOCUMENTS

| | | | | |
|---|---|---|---|---|
| 4,643,454 | A * | 2/1987 | Ondis | 283/74 |
| 5,618,063 | A * | 4/1997 | Chang et al. | 283/67 |
| 6,379,742 | B1 * | 4/2002 | Behm et al. | 427/7 |
| 6,390,916 | B1 * | 5/2002 | Brown | 463/17 |
| 6,544,925 | B1 * | 4/2003 | Prusik et al. | 503/201 |
| 2002/0065197 | A1 * | 5/2002 | Liang et al. | 503/226 |
| 2004/0067478 | A1 * | 4/2004 | Epstein | 434/353 |

* cited by examiner

*Primary Examiner*—Huan Tran
(74) *Attorney, Agent, or Firm*—Benjamin Mieliulis

(57) ABSTRACT

A secure point of sale imageable substrate is disclosed comprising a heat sensitive recording material for recording confidential information. The heat sensitive recording material comprises a heat transmissive optically opaque paper support, a heat sensitive imaging layer coated on the paper support, a removable cover sheet, and a transparent layer or sheet positioned between the heat sensitive layer and the removeable cover sheet. A method for recording confidential information using such a secure point of sale imageable substrate is also disclosed.

8 Claims, 4 Drawing Sheets

SECURE POINT OF SALE IMAGEABLE SUBSTRATE

This application under 35 USC § 111(a) claims benefit per 35 USC § 119(e) to application Ser. No. 60/425,279 filed Nov. 12, 2002 as a provisional application per 35 USC § 111(b).

BACKGROUND OF THE INVENTION

1. Field of the Invention

This invention relates to security substrates, particularly thermally imageable substrates useful for secure point of sale imaging in diverse applications such as mailers and lottery tickets.

2. Description of the Background Art

A variety of constructions of secure substrates such as lottery tickets are known. U.S. Pat. No. 6,308,991, for example, describes a lottery ticket with an authentication feature of a bar code covered by a scratch off layer. The ticket indicia is pre-printed and covered by a scratch-off layer to obscure the pre-printed indicia.

Alternative lottery ticket designs include pull tabs that cover pre-printed indicia. Examples of such constructs are taught in U.S. Pat. Nos. 6,390,916 and 6,379,742.

A need exists to be able to securely print information indicia to a secure substrate at the point of sale to minimize the need or extent of pre-printing required and to add versatility to gaming systems.

U.S. Pat. No. 4,677,553 teaches a scratch off opaque overlay responsive to thermal printing to print confidential information into a concealed area. Scratch off ink of Electron in Carlstradt, N.J. taught as the scratch off material.

The above systems have the drawback that the removed ink create debris, are not convenient for the consumer, and the removal process can damage the image if excessive force is used with a sharp instrument to scratch off the removal ink.

SUMMARY OF THE INVENTION

Figure 1:
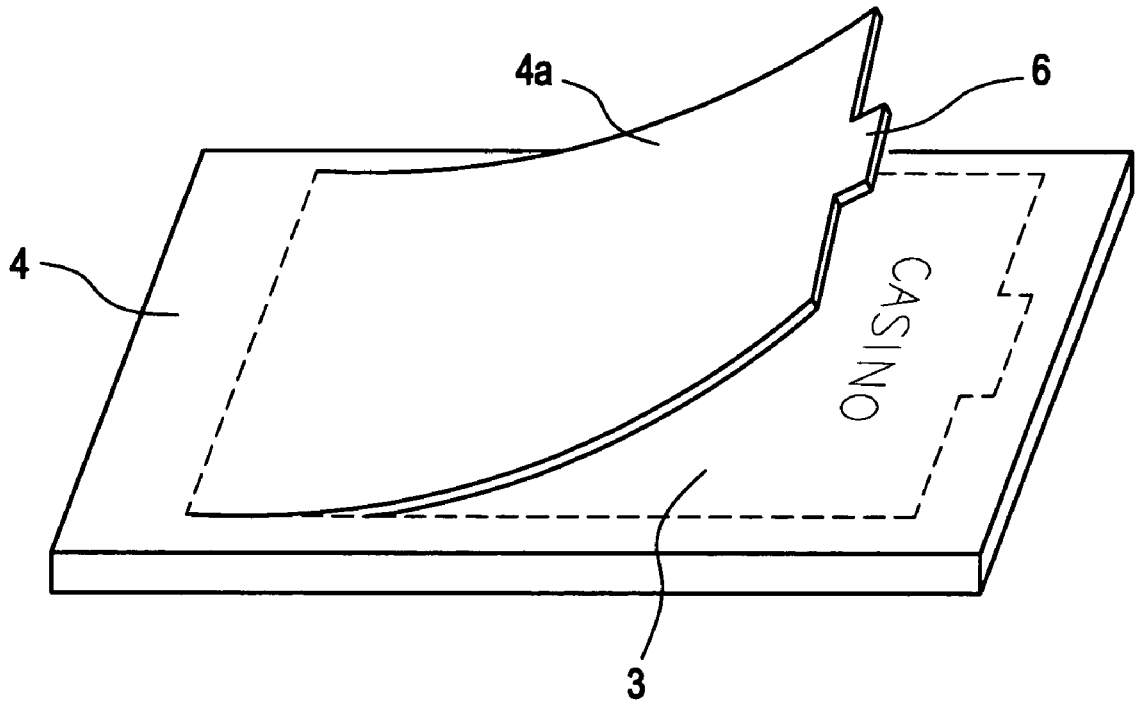
FIG. 1 depicts a heat sensitive record material according to the invention employing a removable cover sheet and fashioned into a lottery ticket.

The invention is a heat sensitive recording material for recording confidential information and comprises (i) a heat transmissive, optically opaque paper support, (ii) a heat sensitive imaging layer coated on the paper support, (iii) a transparent sheet having top and bottom surfaces applied over the heat sensitive imaging layer, (iv) a removable cover sheet applied over the transparent sheet covering the heat sensitive imaging layer, wherein the heat sensitive imaging layer is able to be imaged through the opaque paper support, and read through the transparent layer when the cover is separated from the transparent sheet. The heat sensitive imaging layer is imaged by conventional techniques such as applying a thermal print head, laser, infrared heat source, pin point heat source or other heat source, preferably selectively, to image information in the heat sensitive layer. The heat sensitive recording material can optionally include in addition a UV (ultraviolet resistant) coating over the heat sensitive layer. The removable cover sheet can comprise a pull tab. The transparent sheet can be polymeric film or paper such as a glassine paper. The recording material is selected such that the heat transmissive paper support is infrared transparent or heat conductive.

As an alternative embodiment the heat sensitive recording material for recording confidential information comprises (i) a substantially optically opaque paper support, (ii) a heat sensitive imaging layer, (iii) a heat transmissive optically-transparent sheet applied over the heat sensitive imaging layer, (iv) a heat transmissive optically opaque removable cover sheet applied over the heat transmissive optically-transparent sheet covering the heat sensitive imaging layer, wherein the heat sensitive imaging layer is able to be imaged through the cover sheet and optically-transparent sheet, and read through the optically-transparent sheet when the cover sheet is separated from the optically-transparent sheet. The recording material can include in addition a UV layer ("layer" for purposes hereof includes coating, layer, ply or sheet) applied over the heat sensitive layer. The removable cover sheet can be fashioned as a pull tab. The coversheet and transparent layers are selected to be sufficiently transparent to heat conductivity or infrared radiation to enable the heat sensitive imaging layer to be imaged through the cover sheet and transparent sheet.

Disclosed also is a method of recording confidential information comprising providing a substrate assembly comprising a heat transmissive optically opaque paper support, a heat sensitive layer over the paper support, a transparent cover sheet over the heat sensitive layer, and a removable cover sheet, the transparent sheet positioned between the heat sensitive layer and the cover sheet, and imaging the substrate assembly through the opaque paper support with a reverse image. The image is intended to be viewed through the transparent sheet from a direction opposite to the direction of imaging through the opaque support. The method of recording confidential information can also comprise providing a substrate assembly comprising a substantially optically opaque paper support, a heat sensitive layer over the paper support, a transparent sheet over the heat sensitive layer, and a removable cover sheet, the transparent sheet positioned between the heat sensitive layer and the cover sheet. The transparent sheet and removable cover sheet are selected to be heat transmissive, the removable cover sheet additionally being substantially optically opaque. Thermally imaging the heat sensitive layer of the substrate assembly is accomplished using a thermal print head or infrared radiation or other source of applied heat through the cover sheet and transparent sheet.

DETAILED DESCRIPTION

The present invention is a heat sensitive recording material for recording confidential information. A typical application would be for point of sale lottery tickets.

The recording material is a multi-layer assembly comprising an opaque paper support. On one surface of the paper support, a heat sensitive imaging layer is coated. It should be understood that heat sensitive imaging compositions of chromogen and developer are typically coated onto a paper support. The heat sensitive layer of course can be built up from several layers of chromogen, developer, modifier, binder or sensitizer components. All such variations of the layer constituting multiple layers are understood as encompassed by the term heat sensitive imaging layer as used herein for purposes of this application.

A transparent sheet or layer is applied over the heat sensitive imaging layer. Sheet or layer are understood to be interchangeable in meaning for purposes of the invention since layer can be formed by lamination or optionally by applying a layer of a coating. The transparent sheet serves to protect the imaging layer. If desired, a UV absorber or blocking material can be included in or on a surface or both surfaces of the transparent sheet or layer.

A removable cover sheet is applied over the transparent sheet or layer.

The UV (ultra violet) resistant layer for purposes hereof, can be a coating layer or sheet, can be produced by dispersing an ultraviolet absorber uniformly in a binder. As a method of forming the UV resistant layer, ultraviolet absorbers such as a benzotriazole type, benzophenone type, salicylic acid type, a hydroquinone type and hindered amine types may be utilized The ultraviolet resistant layer can be in the form of a coated coatable fluid, or laminated sheets of clear synthetic resinous materials or coated or impregnated paper materials that incorporate the UV absorber. Optionally a fluorescent material can be included in the UV resistant layer that converts long wavelength ultraviolet into longer wavelength blue light to increase the ultraviolet blocking efficiency up to 400 nm. UV absorbers include: Uvitex OB (Ciba-Geigy); Tinuvin 328 (Ciba-Geigy). Examples of a benzophenone type are 2-hydroxy-4-n-octoxybenzophenone such as CHIMASSORB 81 FL (a product of Ciba-Geigy); 2-hydroxy-4-methoxy-2'-carboxybenzophenone; 2,4-dihydroxybenzophenone; 2,2'-dihydroxy-4,4'-dimethoxy-benzophenone such as Uvinul D-49 (a product of BASF); 2-hydroxy-4-benzoyloxybenzophenone; 2,2'-dihydroxy-4-methoxy-benzophenone such as Cyasorb UV-24 (a product of ACC); 2-hydroxy-4-methoxy-5-sulfonebenzophenone; 2,2',4,4'- tetrahydroxybenzophenone; 2,2'-dihydroxy-4,4'-dimethoxy-5-sodium sulfonebenzophenone; 4-dodecyloxy-2-hydroxy-benzophenone; and 2-hydroxy-5-chlorobenzophenone and the like. Examples of a benzotriazole type are 2-(5'-methyl-2'-hydroxyphenyl)benzotriazole such as Tinuvin P (a product of Ciba-Geigy); 2-(2'-hydroxy-5'-tert-butylphenyl)-benzotriazole such as Tinuvin PS (a product of Ciba-Geigy); 2-[2'-hydroxy-3',5'-bis a,a-dimethylbenzyl)-phenyl]-2H-benzotriazole such as Tinuvin 234 (a product of Ciba-Geigy); 2-(3',5'-di-tert-butyl-2'-hydroxyphenyl-benzotriazole such as Tinuvin 320 (a product of Ciba-Geigy); 2-(3'-tert-butyl-5'-methyl-2'-hydroxyphenyl)-5-chlorobenzotriazole such as Tinuvin 326 (a product of Ciba-Geigy); 2-(3',5'-di-tert-butyl-2'-hydroxyphenyl)-5-chlorobenzotriazole such as Tinuvin 327 (a product of Ciba-Geigy); 2-(3',5'-di-tert-amyl-2'-hydroxyphenyl)-triazole such as Tinuvin 328 (a product of Ciba-Geigy); 5-tert-butyl-3-(5-chloro-2H-benzotriazol-2-yl)-4-hydroxybenzenepropionic acid octyl ester such as Tinuvin 109 (a product of Ciba-Geigy); and 2-(2'-hydroxy-3,5-di-(1,1'-dimethylbenzyl)phenyl)-2H-benzotriazole such as Tinuvin 900 (a product of Ciba-Geigy) and the like. Examples of a salicylic acid type are phenyl salicylate such as Seesorb 201 (a product of Shiraishi Calcium); p-tert-butyl salicylate such as Sumisorb 90 (a product of Sumitomo Chemical); and p-octylphenyl salicylate (a product of Eastman Chemical) and the like. Examples of a hydroquinone type are hydroquinone and hydroquinone salicylate and the like.

The optional fluorescent material is one which absorbs ultraviolet light of a wavelength region of 340–400 nm and emits the light within a range of 400–500 mn. A fluorescent material absorbs the long-wave region of ultraviolet light and, therefore, fading, discoloration and decolorization of the colorant can be effectively prevented when a fluorescent material is contained. Examples of a fluorescent material are materials of a diaminostilbene type, an imidazole type, a thiazole type, an oxazole type (such as 2,5-bis[5-tert-butyl-benzoxazol-2-yl]thiophene [Uvitex OB, a product of Ciba-Geigy]), a triazole type, an oxadiazole type, a thiadiazole type, a coumarin type, a naphthalimide type, a pyrazoline type, a pyrene type, an imidazolone type, a benzidine type, a diaminocarbazole type, an oxacyanine type, a methine type, a pyridine type, an anthrapyridazine type, a distyryl type and a carbostyryl type and the like. Preferably, an oxazole type is used.

The ultraviolet resistant layer optionally can comprise a substrate where a ultraviolet absorber is provided on one surface of the substrate, and there is provided on the opposite surface of the substrate, fluorescent material alone or in combination with ultraviolet radiation absorber.

The ultraviolet resistant layer serves to protect the imaging layers from the effects of ambient ultraviolet radiation. Leuco and fluoran dyes are susceptible to undergoing color changes when exposed to ultraviolet radiation during storage before or after imaging; such color changes are undesirable since they can fade the image. The ultraviolet resistant layer for examples can comprise a thin film of poly(methyl methacrylate) (Elvacite, DuPont de Nemours, Wilmington, Mass.), coated with a solvent solution of Tinuvin 328 (Ciba-Geigy, Ardsdale, N.Y.).

With the construction of the secure imageable substrate according to the invention, the heat sensitive imaging layer is able to be imaged through the opaque paper support. Confidential information can be transferred using a thermal print head at the point of sale. The information is recorded on the internal ply constituting the heat sensitive imaging layer. Confidentiality of the information is preserved since the information is not able to be read until the cover sheet on the opposite side of the assembly is lifted and separated away from the transparent sheet.

The cover sheet is removable in the sense that it is torn along a perforation or separation line. The removable cover sheet can be fashioned to be completely removed or partially removed such as a pull tab where one edge is not perfed so as to minimize pull tab litter by keeping a portion of the removable cover sheet permanently adhered to the assembly. All such assemblies, completely removable or partially removed, are intended encompassed by the concept of "separated from" in describing a cover sheet. "Separated from" means complete removal or partial removal such as lifting up or pulling back to reveal the underlying sheet or layer.

The opaque support such as a sheet of paper can be made opaque through a variety of techniques such as selection of a pigmented support such as a dark colored sheet of paper or film. The paper can also be made opaque by application of inks or printing to obscure light transmission.

In one embodiment of the invention, the opaque support sheet is fashioned to be opaque to light transmission but heat transmissive to infrared radiation or conductive heat. Heat is conveyed through applying a point source device such as a thermal print head.

A sheet or layer can be made heat transmissive but optically opaque by selecting a very thin sheet or layer (such as less than about 3 mils). The sheet is selected to be thin enough to allow heat transmission. By optional application of an ink, which is optically opaque, the heat transmissive sheet, can be simultaneously rendered more fully optically opaque. Optically opaque, heat transmissive sheets can include thin paper and thin films with thin paper preferred. Optically opaque means that underlying texts, images, and other information are generally not readable through the sheet. The heat of a thermal print heat typically used in thermal paper imaging is able to pass through the sheet to the heat sensitive imaging layer when a sheet is heat transmissive.

"Heat transmissive" means that the substrate or layer is heat conductive or infrared transparent in the sense that sufficient heat passes through the sheet or material to be able to reach the heat sensitive imaging layer so that an image is formed therein. Clearly some portion of the infrared or heat radiation is likely to be absorbed, but for purposes hereof, a material is "heat transmissive" if it allows enough heat to pass through to reach the heat sensitive imaging layer such that recording of information in the heat sensitive layer occurs. In this manner an image or characters, letters or numbers in the form of an image is recorded. Common thermal print heads in use today impart on the order of at least 0.2 mj/dot of heat energy (8 dots per mm). Heat transmissivity to the heat sensitive imaging layer of at least 0.2 millijoules per dot is therefore desirable.

If the heat transmissive layer is a sheet, thin papers and thin films are workable with thin papers being preferred. If the heat transmissive layer is a coating, the coating can be selected from thin coatings of inks, lacquers, pigments, pigments and polymeric matrix, paints, scratch-off inks, scratch-off coatings, dyes, clay coatings, mineral pigment and binder coatings such as titanium dioxide ($TiO_2$). The binder can be a polymeric material or latex. Preferred water soluble binders include polyvinyl alcohol, hydroxy ethylcellulose, methylcellulose, methyl-hydroxypropylcellulose, starch, styrene maleic anhydride salts, modified starches, gelatin and the like. Eligible latex materials include polyacrylates, styrene-butadiene-rubber latexes, polyvinylacetates, polystyrene, and the like. Scratch-off coatings can include elastomeric polymeric resins such as acrylic resin described in U.S. Pat. No. 5,215,576 to Carrick, incorporated herein by reference.

Figure 2:
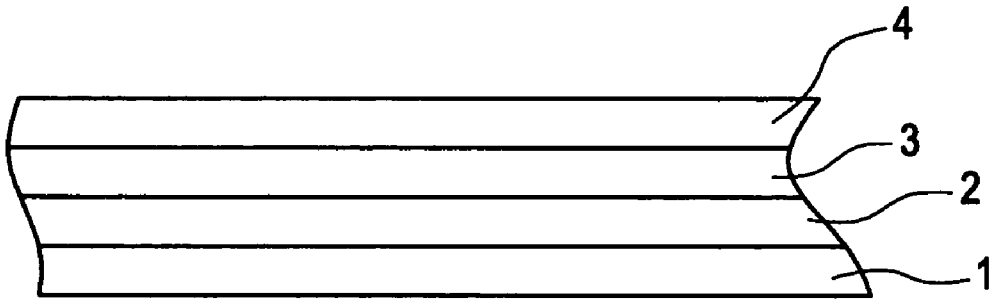
FIG. 2 illustrates four layers that comprise the record material of FIG. 1.

Looking now at the drawings, FIGS. 1 and 2 depict an embodiment according to the invention.

FIG. 2 illustrates a lottery ticket comprised of four layers. FIG. 2 is a side cross section of the ticket of FIG. 1. Opaque layer 1 is overlayed with heat sensitive imaging layer 2. Transparent sheet 3 is applied over heat sensitive imaging layer 2.

Cover sheet 4, part of whose surface is shown fashioned as a partial lift off tab or removeable cover sheet, namely pull tab 4*a*, is positioned over transparent sheet 3 and the various layers 1, 2, 3, and 4 are unitized into a single assembly constituting a ticket stock or mailer, depending on the intended use. The unitizing can be accomplished by gluing the edges of the layers together or other appropriate adhering means including stitching, gluing, embossing, stapling, knurling and the like without limitation.

The substrate assembly constituting the lottery ticket depicted by FIGS. 1 and 2 can be imaged by applying a thermal print head of a thermal printer to the underside of the lottery ticket, to opaque layer 1. FIG. 2 is a cross section of the lottery ticket depicted in FIG. 1 showing the sheets or layers comprising the ticket. The substrate assembly is imaged through backside opaque layer 1 such as by use of thermal print head thereby thermally imaging the heat sensitive layer 2. The thermal print head enables selective application of heat to be applied. The image on heat sensitive layer 2 is a reverse image in that the image is viewed from the opposite side of the substrate assembly, namely viewed through transparent layer 3 when cover sheet 4, such as pull tab 4*a* is separated from or pulled back from transparent layer 3. "Layer" for purposes of this invention is defined to include layers, sheets, plies and coatings, any and each of which can be a layer for purposes of the invention.

Transparent layer 3 can serve as a viewing window and protection for the image of heat sensitive layer 2. Information thermally imprinted to heat sensitive layer 2 through application of the thermal print head to optically opaque layer 1 is preserved as confidential until removable cover sheet 4 is lifted or pulled back or torn open along pull tab 4*a* perforation lines.

In an alternative embodiment, the heat sensitive recording material for recording confidential information can comprise a transparent sheet having first and second surfaces and having coated on the first surface a heat sensitive imaging layer.

An infrared transparent, optically opaque layer can be coated over the heat sensitive imaging layer. A removable cover sheet can then be applied over the second surface of the transparent sheet. The heat sensitive imaging layer coated on the first surface is then able to be imaged by selective application of heat such as with a thermal print head or other infrared or other heat source, through the optically opaque layer. The information imaged can then be read through the transparent sheet when the cover sheet is separated from the transparent sheet.

Figure 3:
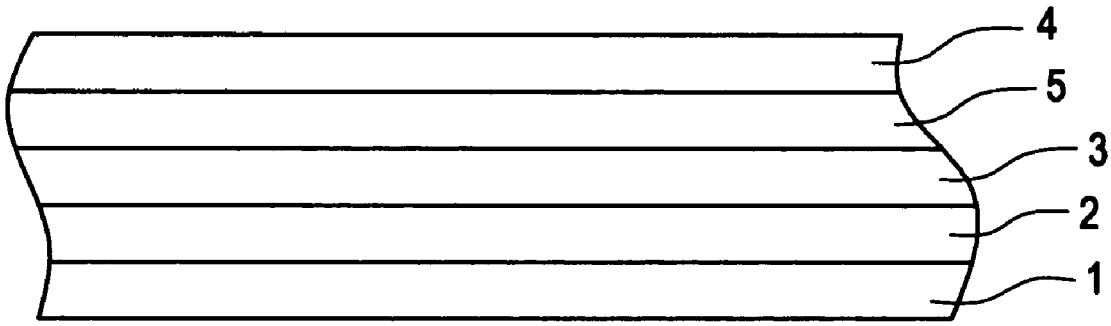
FIG. 3 illustrates a five layer alternative embodiment.

FIG. 3 illustrates a side cross-section of an alternative embodiment of a lottery ticket such as in FIG. 1 wherein ultraviolet resistant layer 5 is added as a separate layer or substrate between cover sheet 4 and transparent layer 3. The UV resistant layer 5 can optionally be positioned between transparent layer 3 and heat sensitive layer 2.

Figure 4:
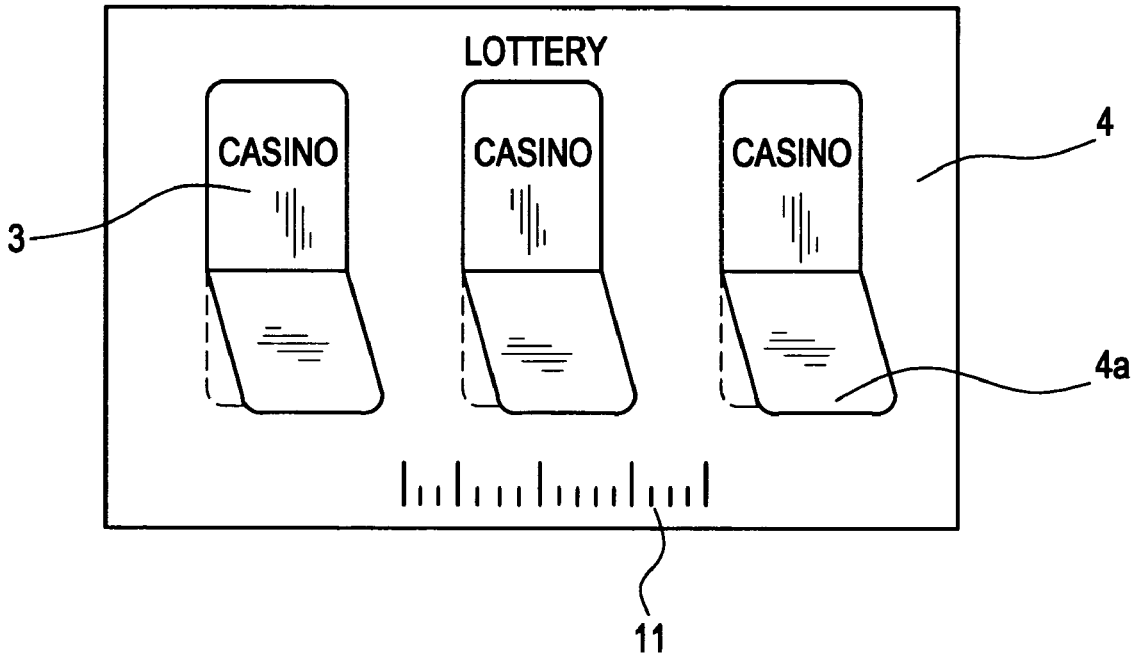
FIG. 4 illustrates an alternative embodiment of a lottery ticket using three lift off tabs.

FIG. 4 illustrates a lottery ticket similar to that depicted in FIG. 1 wherein removable cover sheet 4 constitutes three pull tabs 4*a*.

Figure 5:
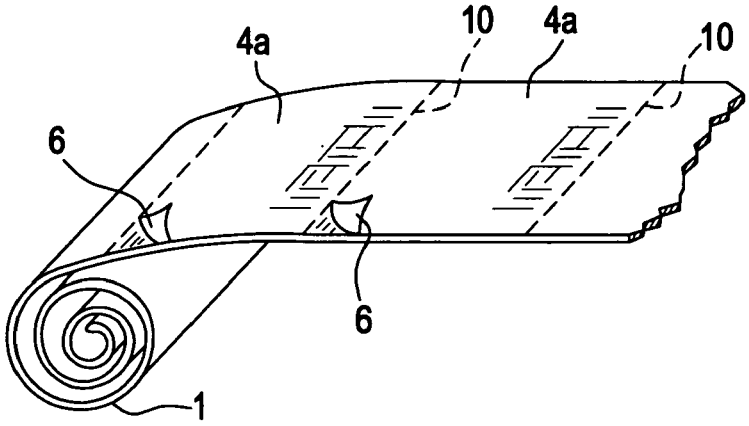
FIG. 5 illustrates an embodiment of a roll of secure point of sale imageable substrate.
Figure 6:
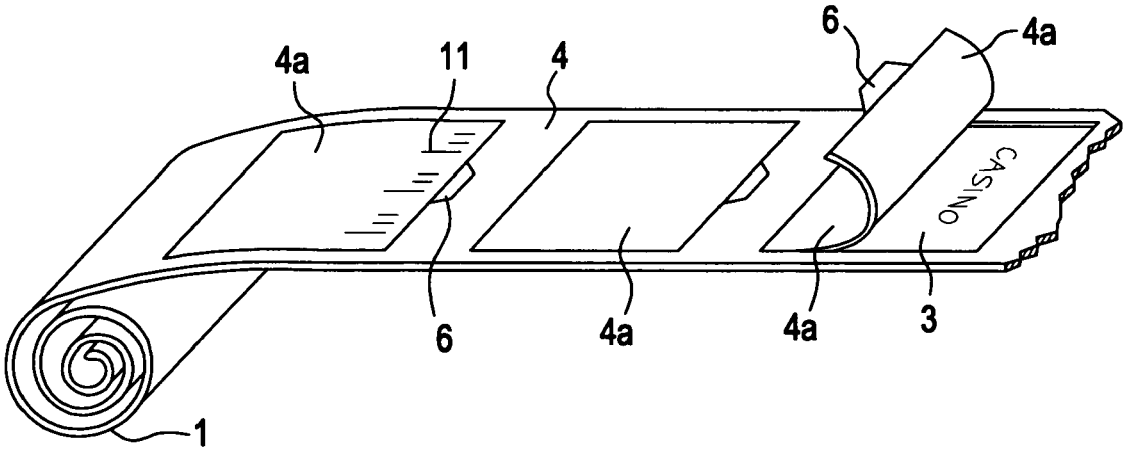
FIG. 6 illustrates yet another embodiment of the secure point of sale imageable substrate in roll form.

FIGS. 5 and 6 illustrate alternate embodiments of a roll of the secure point of sale imageable substrate of the invention. The imageable substrate assembly is depicted in FIG. 5 as able to be separated along a perforation line 10. Removable cover sheet 4 is shown as pull tab 4*a* covering essentially the entire surface leaving no carcass having a lift off area 6 (grasping aid) to enable easy peeling back of cover sheet 4. FIG. 1 shows an alternate style of a lift off area 6 to enable easy grabbing of the pull tab using two fingers.

The heat sensitive imaging or thermally imaging layer can itself be one or more layers and can comprise a chromogenic material and an acidic developer material in substantially contiguous relationship, whereby the melting, softening or sublimination of either material produces a color, in other words a change-in-color reaction.

A sensitizer (also known as a modifier) such as a 1,2-diphenoxyethane and the like is preferably included. Such material typically does not impart any image on its own and is not considered active in the formation of color but as a relatively low melting solid acts as a solvent to facilitate reaction between the mark-forming components. Other such sensitizers are described in U.S. Pat. No. 4,531,140. Other sensitizers for example can include N-acetoacetyl-o-toluidine, phenyl-1-hydroxy-2-naphthoate, dibenzyloxalate, and para-benzylbiphenyl.

The color-forming composition comprises chromogenic in its substantially colorless state and acidic developer material. Chromogenic materials are also known as color formers or dye precursors. They are typically electron donors. The dye precursors or chromogenic materials react with acidic developer material to express a dye. The color-forming system typically relies upon melting, softening, or subliming one or more of the components to achieve reactive, color-producing contact.

The term sheet is intended to be liberally construed as abroad surface encompassing webs, plies, sheets in roll form, rectangular pieces of paper or other shape, but also a large surface in a general sense such as a web, ply, rubbery tape and the like. A substrate or sheet for purposes hereof is understood to encompass paper and synthetic webs, ribbons, tapes, belts, films, plies and the like. These materials typically have two large surface dimensions and a comparatively small thickness dimension. Each substrate can be appropriately selected to be opaque, optically transparent or translucent or heat transmissive to fit the need or as desired and each could, itself, be colored or not. The material can be fibrous including, for example, paper and filamentous synthetic materials. It can be a film including, for example, cellophane and synthetic polymeric sheets cast, extruded, or otherwise formed.

The thermally imaging coating comprises the color-forming composition chromogenic materials positioned proximate to a developer material.

The components of the color-forming system are in a proximate relationship meaning, substantially contiguous or near contiguous relationship, substantially homogeneously distributed throughout the coated thermally imaging layer material deposited on the opaque support substrate and can be in one or more layers. One layer for example could be chromogenic material. Developer could be included in this layer or in a separate layer. Similarly a sensitizer could be included in the chromogenic material layer, or in the developer layer or as a separate layer. Various such layering techniques are meant by the term proximate relationship and can constitute the heat sensitive imaging layer for purposes hereof. In manufacturing the thermally imaging material, a coating composition is prepared which includes a fine dispersion of the components of the color-forming system, binder material typically a polymeric material, surface active agents and other additives in an aqueous coating medium. A protective topcoat such as polyvinylalcohol or its derivatives or other binder materials can be optionally utilized. The composition can additionally contain inert pigments, such as clay, talc, aluminum hydroxide, calcined kaolin clay and calcium carbonate; synthetic pigments, such as urea-formaldehyde resin pigments; natural waxes such as Carnauba wax, synthetic waxes; lubricants such as zinc stearate; wetting agents; defoamers, and antioxidants.

The color-forming system components are substantially insoluble in the dispersing vehicle (preferably water) and are ground to an individual average particle size of between about 1 micron to about 10 microns, preferably less than 30 microns. A binder can be included. The binder can be a polymeric material and is substantially vehicle soluble although latexes are also eligible in some instances. Preferred water soluble binders include polyvinyl alcohol, hydroxy ethylcellulose, methylcellulose, methyl-hydroxypropylcellulose, starch, styrene maleic anhydride salts, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of the sheet or label. Binder should be present in an amount to afford such protection and in an amount less than will interfere with achieving reactive contact between color-forming reactive materials.

Thermally imaging coating weights can effectively be about 3 to about 9 grams per square meter (gsm) and preferably about 5 to about 6 gsm. The practical amount of color-forming materials is controlled by economic considerations, functional parameters and desired handling characteristics of the coated labels.

The chromogens can include any of the conventional chromogens such as the phthalide, leucoauramine and fluoran compounds. Other examples of chromogens compounds include Crystal Violet Lactone (3,3-bis(4-dimethylaminophenyl)-6-dimethylaminophthalide, U.S. Pat. No. re. 23,024); phenyl-, indolyl, pyrrolyl, and carbazolyl substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. Nos. 3,775,424 and 3,853,869).

Other specifically eligible chromogenic compounds which can be used in combination include 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-di-n-butylamino-6-methyl-7-anilino-fluoran; 3-di-n-butylamino-7-(2-chloroanilino)fluoran; 3-(N-ethyl-N-tetrahydrofurfurylamino)-6-methyl-7-3,5'6-tris(dimethylamino)spiro[9H-fluorene-9,1'(3'H)-isobenzofuran]3'-one; 7-(1-ethyl-2-methylindole-3-yl)-7-(4-diethyl-amino-2-ethoxyphenyl)-5,7-dihydrofuro[3,4-b] pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindole-3-yl)-7-(4-diethyl-amino-2-ethoxyphenyl)-5,7-dihydrofuro[3,4-b]pyridin-5-one; 3-diethylamino-7,8-benzofluoran; 3,3-bis (1-ethyl-2-methylindole-3-yl)phthalide; 3-diethylamino-7-anilinofluoran; 3-diethylamino-7-benzylaminofluoran; 3'-phenyl-7-dibenzylamino-2,2'-spirodi[2H-1-benzopyran] and mixtures of any of the above.

In addition to the developer of Formula II, other developer materials can be used in combination. Examples of such other eligible acidic (or electron accepting) color-developer material include the compounds listed in U.S. Pat. No. 3,539,375 as phenolic reactive material, particularly the monophenols and diphenols. Other eligible acidic developer materials also include, without being considered as limiting, the following compounds which may be used individually or in mixtures: 4,4'-isopropylidine-diphenol (Bisphenol A); p-hydroxybenzaldehyde; p-hydroxybenzophenone; p-hydroxypropiophenone; 2,4-dihydroxybenzophenone; 1,1-bis (4-hydroxyphenyl)cyclohexane; salicylanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; bis(3-allyl-4-hydroxyphenyl) sulfone, 2,2-bis(4-hydroxyphenyl)-4-methylpentane; benzyl-4-hydroxyphenyl ketone; 2,2-bis(4-hydroxyphenyl)-5-methylhexane; ethyl-4,4-bis(4-hydroxyphenyl)-pentanoate; isopropyl-4,4-bis(4-hydroxyphenyl)pentanoate; methyl-4,4-bis(4-hydroxyphenyl)pentanoate; allyl-4,4-bis(4-hydroxyphenyl)pentanoate; 3,3-bis(4-hydroxyphenyl)-pentane; 4,4-bis(4-hydroxyphenyl)heptane; 2,2-bis(4-hydroxyphenyl)-1-phenylpropane; 2,2-bis(4-hydroxyphenyl)butane; 2,2'-methylene-bis(4-ethyl-6-tertiarybutylphenol); 4-hydroxycoumarin; 7-hydroxy-4-methylcoumarin; 2,2'-methylene-bis(4-octylphenol); 4,4'-sulfonyldiphenol; 4,4'-thiobis (6-tertiarybutyl-m-cresol); methyl-p-hydroxybenzoate; n-propyl-p-hydroxybenzoate; benzyl-p-hydroxybenzoate; 4-(4-(1-methylethoxy)phenyl) sulphonyl phenol. Preferred among these are the phenolic developer compounds. More preferred among the phenol compounds are 4,4'-isopropylidinediphenol, ethyl-4,4-bis(4hydroxyphenyl)pentanoate, n-propyl-4,4-bis(4-hydroxyphenyl) pentanoate, isopropyl-4,4-bis(4-hydroxyphenyl)pentanoate, methyl-4,4-bis(4-hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl) cyclohexane, and benzyl-p-hydroxybenzoate; 4-(4-(1-methylethoxy)phenyl)sulphonyl phenol and 4,4'-[1,3-phenylenebis(1-methylethylene)]bisphenol. Acidic compounds of other kind and types are eligible. Examples of such other acidic developer compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen. Of the foregoing particularly the phenol type of compounds are more preferable acidic developer materials.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component was prepared by milling the component in an aqueous solution of the binder until a particle size of between about 1 micron and 10 microns was achieved. The desired average particle size was less than 3 microns in each dispersion.

The thermally imaging coat was made by making separate dispersions of chromogenic material and acidic material. The dispersions were mixed in the desired ratios and the applied to the substrate with a wire wound rod and dried. Other non-active (as that term is understood in this application) materials such as modifiers, fillers, antioxidants, lubricants and waxes can be added if desired. The label stock may be calendered to improve smoothness.

In the examples of the thermal response of the label stock was checked by imaging with a Group III facsimile machine. This facsimile machine used included SHARP 220. The color produced was measured with a Macbeth RD514 densitometer, #106 filter. The dispersions were prepared in a quickie mill, attritor and small media mill. Nopco NDW is a sulfonated castor oil produced by Nopco Chemical Company. Surfynol 104 is a di-tertiary acetylene glycol surface active agent produced by Air Products and Chemicals, Inc.

What is claimed is:

1. A heat sensitive recording material for recording confidential information comprising:

(i) a heat transmissive, optically opaque paper support, (ii) a heat sensitive imaging layer coated on the paper support, (iii) a transparent sheet applied over the heat sensitive imaging layer, (iv) a removable cover sheet applied over the transparent sheet covering the heat sensitive imaging layer, wherein the heat sensitive imaging layer is able to be imaged through the opaque paper support, and read through the transparent sheet when, the removable cover sheet is separated from the transparent sheet, and wherein the recording material includes in addition a UV resistant layer applied over the heat sensitive layer.

2. A heat sensitive recording material for recording confidential information comprising:

(i) a heat transmissive, optically opaque paper support, (ii) a heat sensitive imaging layer coated on the paper support, (iii) a transparent sheet applied over the heat sensitive imaging layer, (iv) a removable cover sheet applied over the transparent sheet covering the heat sensitive imaging layer, wherein the heat sensitive imaging layer is able to be imaged through the opaque paper support, and read through the transparent sheet when, the removable cover sheet is separated from the transparent sheet, and wherein the recording material includes a UV resistant coating applied to a surface of the transparent sheet.

3. A heat sensitive recording material for recording confidential information comprising:

(i) a heat transmissive optically opaque paper support, (ii) a heat sensitive imaging layer coated on the paper support, (iii) a removable cover sheet, (iv) a transparent layer positioned between the heat sensitive imaging layer and the removable cover sheet, and wherein the recording material includes in addition a UV resistant layer applied over the heat sensitive layer.

4. A heat sensitive recording material for recording confidential information comprising:

(i) a heat transmissive optically opaque paper support, (ii) a heat sensitive imaging layer coated on the paper support, (iii) a removable cover sheet, (iv) a transparent layer positioned between the heat sensitive imaging layer and the removable cover sheet, and wherein the recording material includes a UV resistant coating applied over the transparent layer.

5. A heat sensitive recording material for recording confidential information comprising:

i) a substantially optically opague paper support, ii) a heat sensitive imaging layer, iii) a heat transmissive optically-transparent sheet applied over the heat sensitive imaging layer, iv) a heat transmissive, optically opague removable cover sheet applied over the heat transmissive optically-transparent sheet covering the heat sensitive imaging layer, wherein the heat sensitive imaging layer is able to be imaged through the cover sheet and optically-transparent sheet, and read though the optically-transparent sheet when the cover sheet is separated from the optically-transparent sheet and wherein the recording material includes in addition a UV resistant layer applied over the heat sensitive layer.

6. The recording material according to claim 5 wherein the removable cover sheet is a pull tab.

7. The recording material according to claim 5 wherein the a cover sheet and transparent sheet are sufficiently heat transmissive to enable the heat sensitive imaging layer to be imaged through the cover sheet and transparent sheet.

8. A heat sensitive recording material for recording confidential information comprising:

(i) a transparent sheet having first and second surfaces and having coated on the first surface a heat sensitive imaging layer;

(ii) a heat transmissive, optically opaque layer coated over the heat sensitive imaging layer;

(iii) a removable cover sheet applied over the second surface of the transparent sheet, wherein the heat sensitive imaging layer coated on the first surface is able to be imaged by application of heat through the optically opaque layer, and read through the transparent sheet when the cover sheet is separated from the transparent sheet, and wherein a layer of a UV resistant coating is interposed between the heat sensitive imaging layer and the heat transmissive, optically opaque layer.

* * * * *